US008829818B2

(12) United States Patent
Zudrell-Koch et al.

(10) Patent No.: US 8,829,818 B2
(45) Date of Patent: Sep. 9, 2014

(54) CONTROL OF OPERATIONAL PARAMETERS OF OPERATIONAL DEVICES FOR LEDS

(75) Inventors: Stefan Zudrell-Koch, Hohenems (AT); Rainer Troppacher, Dornbirn (AT); Florian Moosmann, Dornbirn (AT)

(73) Assignee: Tridonic GmbH & Co. KG, Dornbirn (AT)

( * ) Notice: Subject to any disclaimer, the term of this patent is extended or adjusted under 35 U.S.C. 154(b) by 124 days.

(21) Appl. No.: 13/806,860

(22) PCT Filed: Jul. 6, 2011

(86) PCT No.: PCT/EP2011/061404

§ 371 (c)(1),
(2), (4) Date: Feb. 28, 2013

(87) PCT Pub. No.: WO2012/004303

PCT Pub. Date: Jan. 12, 2012

(65) Prior Publication Data

US 2013/0154501 A1 Jun. 20, 2013

(30) Foreign Application Priority Data

Jul. 6, 2010 (DE) ..... 10 2010 031 016

(51) Int. Cl.
*H05B 37/02* (2006.01)
*H05B 33/08* (2006.01)

(52) U.S. Cl.
CPC ..... *H05B 37/02* (2013.01); *H05B 33/0851* (2013.01); *H05B 37/0263* (2013.01)
USPC ..... 315/308; 315/246; 315/291

(58) Field of Classification Search
USPC ..... 315/209 R, 224–226, 246, 291, 307, 315/308, 312
See application file for complete search history.

(56) References Cited

U.S. PATENT DOCUMENTS 6,744,223 B2 * 6/2004 Laflamme et al. ..... 315/291
2007/0228999 A1 10/2007 Kit
2009/0179596 A1 7/2009 Willaert et al.
2010/0141153 A1 6/2010 Recker et al.

FOREIGN PATENT DOCUMENTS

WO WO-2010070676 A2 6/2010

OTHER PUBLICATIONS

International Search Report for PCT/EP2011/061404 dated Nov. 28, 2011.

* cited by examiner

*Primary Examiner* — Jimmy Vu
(74) *Attorney, Agent, or Firm* — Marshall, Gerstein & Borun LLP

(57) ABSTRACT

The invention relates to a method for defining an operational parameter of an operational device for lighting means. According to the method,: a voltage supply of the operational device is preferably switched on/off manually, an on/off switching is evaluated by the operational device as to whether at least one first predetermined criterion is fulfilled, for example, time constants or repetition rates, in this is the case, a continuous, preferably cyclic change of the predetermined operational parameters is switched on by the operational device, the changed operational parameter is returned to the user directly or indirectly, optically and/or acoustically, and the actual value of the changed operational parameters is maintained at a moment in time for a subsequent operation of the lighting means to which an additional on/off switching of the voltage supply fulfills at least one second criterion.

22 Claims, 2 Drawing Sheets

CONTROL OF OPERATIONAL PARAMETERS OF OPERATIONAL DEVICES FOR LEDS

FIELD OF THE INVENTION

The present invention generally relates to the field of controlling operational parameters of operational devices for luminous means, for example LEDs, gas discharge lamps or halogen lamps. The invention may be used, in particular, in the field of so-called retrofit LED lamps which are used as a substitute for incandescent lamps or halogen lamps, for example. Retrofit lamps accordingly have connecting caps with which they can be introduced, for example screwed or plugged, into known lamp holders.

In the text below, "LED" is also understood as meaning "OLED" throughout.

BACKGROUND OF THE INVENTION

The invention is described below, in particular, with regard to retrofit lamps, in particular retrofit LED lamps. However, it should be understood that other, accordingly configured operational devices for luminous means are also intended to be included.

For retrofit lamps, it is important that they can be used to simulate substantially the functionalities known from incandescent lamps. One of these known functionalities is the dimming function. Dimming is conventionally in the form of phase dimming, which entails various problems, in particular when using retrofit LED lamps.

In common LED lamps, dimming is usually carried out via separate control lines by transmitting an item of dimming information, for example a dimming level value, to the LED lamp. This is not possible in the retrofit sector since the required control lines are not already present, but rather there is only a two-wire connection to the lamp.

Lamps which can be switched to two discrete lighting modes by means of particular switch-on/switch-off sequences of an operating voltage or mains voltage are known. Such a lamp according to the prior art can be switched, by means of a simple switching-on operation, to a first lighting mode in which the lamp is operated at full power until being switched off. A sequence of switching-on/switching-off operations which take place in quick succession, for example on-off-on, can be used to switch the lamp to a second lighting mode in which the lamp is operated, for example, at a predetermined lower power, that is to say in a dimmed manner. A switching-off operation returns the lamp to the initial state again, from which either the first or the second lighting mode can be selected again.

This functionality is also known under the term "double click" in which the lamp evaluates rapid, repeated switching (for example twice) of the operating voltage on and off as information, in particular dimming information. If the operating voltage is rapidly switched on and off twice, the ballast electronics of the luminous means therefore interpret that the lamp is operated at reduced power (dimmed).

However, only two predetermined lighting modes are available in the known lamps and the user can only choose between these lighting modes (for example 100% power or 80% power). If dimming to another level is desired, another lamp must be chosen and/or the lamp must be replaced.

OBJECT OF THE INVENTION

The object of the invention is therefore to provide an alternative control method for luminous means, for example for LED lamps and, in particular, but not exclusively, retrofit LED lamps, without the disadvantages described above.

This object is achieved by the features of the independent claims. The dependent claims develop the central idea of the invention.

SUMMARY OF THE INVENTION

The invention achieves the object with a method for predefining an operational parameter of an operational device for a luminous means, for example an LED, the luminous means being controlled via a single-stage or multistage power converter which is clocked at (high) frequency, having the following steps: the voltage supply of the operational device is preferably switched on/off manually, the operational device evaluates whether the switching-on/switching-off operation satisfies at least one first predefined criterion, for example time constants or repetition rates, if so, a discrete or continuous, preferably cyclical, change in the operational parameter to be predefined is initiated by the operational device, the changing operational parameter being directly or indirectly reproduced for the user in an optical and/or acoustic manner, and the current value of the changing operational parameter being recorded for subsequent operation of the luminous means at the time at which a further operation of switching the voltage supply on/off satisfies at least one second criterion, and the changing operational parameter preferably influencing the frequency or the pulse control factor of the power converter.

The method may have the following steps: the current value is stored in a memory in response to the detection of the further switching-on/switching-off operation, and the luminous means, for example LED(s), are operated using the value stored for the operational parameter in the memory.

The LED as luminous means may be replaced with an optical and/or acoustic signaling means.

The method may also have a step for detecting a third switching sequence which again causes the continuous changing of an operational parameter with which the luminous means are operated.

The operational device can be reset to an initial state after a predetermined switched-off time.

The operational device can be reset to an initial state after a further switching sequence is detected.

The switching sequences can be carried out using a switching element.

The operational parameter can be changed using voltage cycles.

The zero crossings of the voltage can be determined and can be used as the time base for synchronizing the change in the operational parameter.

The duration of the change between the first value and the second value of the operational parameter can be defined at a predetermined number of voltage cycles.

The stored value for the operational parameter can correspond to the current value to which the operational parameter is changed.

The operational parameter may be an operating mode selection, a dimming level and/or a power with which the luminous means are operated.

In another embodiment, the invention provides a control circuit comprising a microcontroller and/or an application-specific integrated circuit (ASIC) for operating luminous means, for example one or more LEDs, using the inventive method.

The invention also achieves the object with a lamp consisting of an operational device and luminous means, having a connection which can be used to connect the operational device to a voltage supply, a power converter which is preferably clocked at high frequency and is intended to operate the luminous means, a manipulation sequence detector for detecting at least one switching sequence, a modulator which changes an operational parameter, with which the luminous means is operated, between a first value and a second value, a memory which stores a value corresponding to the operational parameter set by the modulator at a time at which the manipulation sequence detector detects a second switching sequence.

Further advantageous forms of the invention are described below with regard to the drawings.

DETAILED DESCRIPTION OF THE INVENTION

Figure 1:
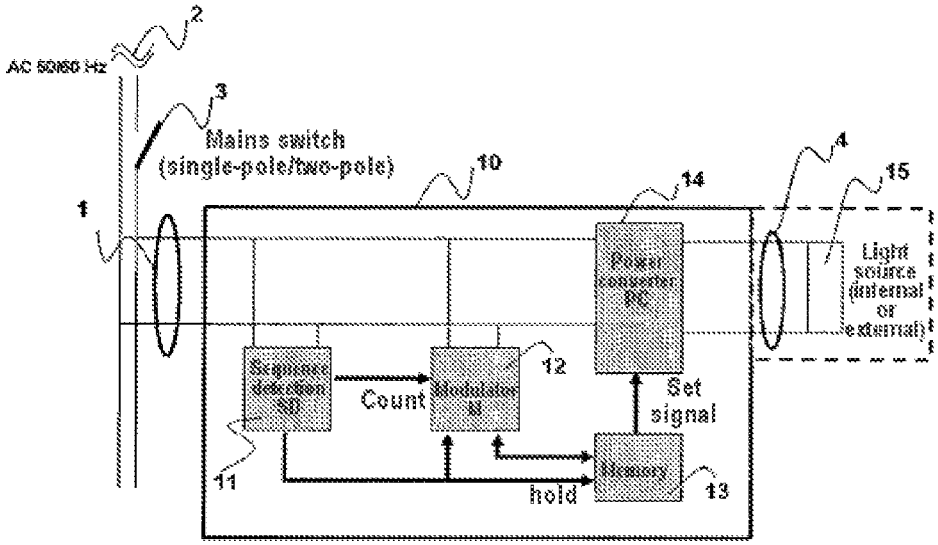
FIG. 1 shows a schematic illustration of a lamp according to the invention consisting of an operational device and a luminous means. The dashed region indicates that the luminous means can either be provided with the operational device or separately from the latter.

A schematic structure of a retrofit lamp according to the invention is now described with regard to FIG. 1. The retrofit lamp consists of an operational device 10 and a luminous means 15, for example an inorganic LED or OLED luminous means. Other luminous means, for example halogen lamps or gas discharge lamps, can also be operated by the operational device.

The operational device 10 is connected to a voltage source 2 via conductors 1. The operational device 10 can be disconnected from the voltage source 2 and connected to the latter by means of at least one (single-pole or two-pole) switching element 3. Instead of the luminous means 15, it is also possible to use another operating means which generates an optical or acoustic emission.

The operational device 10 has a manipulation sequence detector 11, for example a switching sequence detector, a modulator 12, a memory 13 and a power converter 14. The luminous means 15 can be connected to the operational device 10 either directly or via conductors 16. The LED 15 is controlled via the power converter 14 which is clocked at high frequency.

The power converter 14 may be formed by a switching regulator and has at least one circuit breaker which is clocked at high frequency. The power converter 14 may be, for example, an inverter (buck/boost converter), a step-down converter (buck converter), an isolating transformer (flyback converter) or else an isolated or non-isolated half-bridge converter.

The power converter 14 which is schematically illustrated as a block may have a single-stage or multistage design. One or more stages may be actively clocked by one or more control circuits using one or more switches in each case. One example of a multistage design is a two-stage design in which the first stage is an actively clocked PFC (power factor correction) circuit which provides a DC output voltage which is preferably regulated. A second converter stage, which may be a DC/DC converter (for example in the case of LEDs as luminous means) or a DC/AC converter (for example an inverter in the case of gas discharge lamps), is supplied with the DC output voltage from the PFC circuit as intermediate circuit voltage or bus voltage. As stated, the second converter stage may also be actively clocked by one or more switches. For example, the second stage may be a PWM (pulse width) modulator.

In this case, the manipulation sequence detector 11 is set up to detect manipulation sequences or switching sequences produced by switching the switching element 3 on/off. In this case, the manipulation sequence detector 11 monitors criteria, such as time constants and/or repetition rates, in order to discriminate different sequences.

The manipulation sequence detector 11 may be combined with a circuit, as is already used in so-called emergency lighting devices, in order to detect, in the emergency lighting situation, that there is now no AC voltage as the supply voltage for the operational device, but rather a DC voltage is present.

Such a circuit is known from DE 10 2007 040555 A1, the disclosure of which is hereby incorporated by reference.

On the one hand, such an AC/DC detection circuit can thus be used to implement solely the function of detecting the manipulation sequence. As an exemplary embodiment, the operational device is an emergency lighting device in which an AC/DC detection circuit is used both to detect the AC/DC voltage and to detect the temporary disconnection (not replaced with DC) of the AC supply.

The manipulation sequence detector 11 is connected to the modulator 12 and the memory 13. The modulator 12 is connected to the memory 13 and the power converter 14.

The modulator 12 is set up to change an operational parameter, for example a voltage, for the luminous means 15 between a first value, for example a first dimming level, and a second value, for example a second dimming level, or to operate the power converter 14 with values between the first value and the second value or at these values. These values are converted by the power converter 14 in such a manner that the luminous means 15 connected to the power converter 14 produces a desired emission which is between the first value and the second value or at said values. In particular, the operational parameter influences the clocking, for example the frequency or the pulse control factor, of the power converter 14.

In the case of the multistage design of the power converter, the operational parameter may be the clocking of the switch(es) of one of the stages or a plurality of stages. For example, the operational parameter may be the clocking of the switch of a PFC circuit (as the first or only stage), the clocking preferably changing the DC output voltage of the PFC circuit, which preferably influences the light power of the luminous means (dimming via amplitude). However, this dimmability can also be achieved by means of other dimming techniques or may possibly be combined with further dimming techniques of a further stage, for example PWM dimming (preferably for LEDs) or dimming via the frequency in the case of a half-bridge converter (for example for LEDs).

In one embodiment, the first value corresponds to 100% of the possible emission, that is to say 100% light emission for example, and the second value corresponds to a considerably lower percentage of the possible emission, that is to say dimming to 5% light emission for example. However, all values of 0-100% of the possible emission can be selected for the first and second values.

It is also possible for the modulator 12 to start to change the values at the second value, that is to say at the second dimming level for example.

The modulator 12 may also be set up to cyclically change the operational parameter between the first and second values, thus continuously changing the emission.

The modulator 12 may also be set up to cyclically change the operational parameter between the first and second values, the first value being reached again at the end of the cyclical change which can also be run through several times. This makes it possible to ensure that unwanted or incorrect initiation of the cyclical change does not influence the continuous operation.

The memory 13 is connected to the manipulation sequence detector 11, the modulator 12 and the power converter 14. The memory can store a value which indicates the current value for the operational parameter, that is to say a dimming level for a luminous means 15 for example. This value can be used to stipulate how the power converter 14 operates the luminous means 15, that is to say which emission is intended to be set at the luminous means 15.

The operational parameter which is set by a user by manipulating the voltage supply of the operational device may also be an operating mode selection, with the result that it is possible to choose from one of at least two operating modes. The plurality of operating modes are preferably already stored in the operational device in advance (for example by the manufacturer).

In this case, there may be a basic setting ("default setting") which is set by the manufacturer for example, that is to say, in the case of a standard start-up (without operating mode selection by a user), the operational device is configured (preferably in terms of software), for example, in such a manner that it reacts to a (light) sensor ("sensor mode"), that is to say changes the method of operation of the luminous means, in particular adapts their brightness or light power, on the basis of the output signal from the sensor.

If, in contrast, the user generates an operating mode selection by means of a particular sequence (as described) by voltage manipulation, the system changes to a mode which differs from the basic mode and is called the "user mode". This user mode may be an operating mode in which the luminous means are operated with constant power.

The user can therefore choose between an operating mode, in which the operational device dims the luminous means, and an operating mode, in which the luminous means are always operated with constant power ("fixed output").

Provision may also be made for the user to be able to selectively activate or deactivate particular operating blocks (for example heating of the filaments of a gas discharge lamp) in one of the operating modes by means of said supply voltage manipulation of the operational device. Therefore, different energy efficiency levels may possibly also be chosen.

Figure 2:
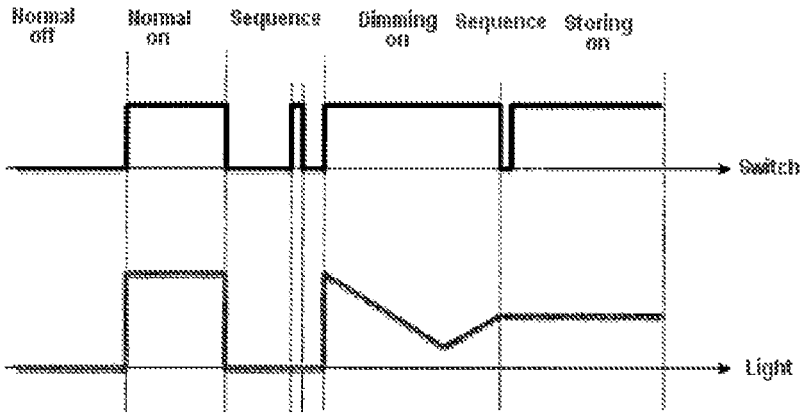
FIG. 2 shows a temporal sequence of manipulation sequences and a resultant emission.

This invention now allows, for example, dynamic dimming according to the following principle (cf. FIG. 2):

The switching element 3, for example the mains switch, is operated in order to switch on the lamp according to the invention or the operational device and to cause a light emission at the luminous means.

This switching-on operation is detected by the manipulation sequence detector 11. If no further action is carried out within a particular time after the voltage has been switched on, the switching-on operation is detected by the manipulation sequence detector 11 as a normal switching-on operation (normal on, top of FIG. 2), for example, and the luminous means is operated at a predetermined power value, for example 100% power. This can also be carried out, for example, in such a manner that the memory 13 contains a particular standard value (default) corresponding to the predetermined power value.

However, if a further switching action, for example a further switching-off and switching-on operation (sequence), is carried out within the particular time after the switching-on operation, this is likewise detected by the manipulation sequence detector 11 and is interpreted as an instruction to change to a dimmed mode. If the manipulation sequence detector 11 detects the instruction to change to the dimmed mode, it instructs the modulator 12 to cyclically control the power converter 14 with values between the first and second dimming levels. This results in the light emission at the luminous means being continuously changed (dimming up and dimming down).

Typical time constants for the dimming-down or dimming-up edge are in the region of a few seconds, that is to say 2 to 10 seconds for example.

In this case, the predetermined time may be a threshold value which is usually considerably less than one second. The operational device will thus cyclically dim down from the nominal value of 100% to a minimum dimming value of 5%, for example, after being rapidly switched on again in order to then dim up again (see the bottom of FIG. 2).

This cyclical dimming-down and dimming-up operation is repeated until the user manually stipulates the current value, freezes it as it were, by rapidly switching the voltage supply off and on (sequence) again.

In this case, the manipulation sequence detector 11 detects a further switching sequence. The instantaneous modulation value is then stored in the memory 13 and the luminous means is operated by the power converter 14 with the modulation value, with an accordingly reduced light emission. The further switching-off/switching-on sequence may correspond to the first switching sequence or may be different from the latter.

After the voltage has been switched off for a further predetermined period, the operational device is reset to an initial state again in one embodiment (the standard value (default), for example, is set in the memory 13).

The memory 13 may also be arranged outside the operational device 10. For example, the operational device 10 may be connected to the memory 13 arranged outside the operational device 10 via an interface. It may thus also be possible, when the operational device 10 is replaced, for the memory 13 to be connected to the newly inserted operational device and for the modulation value stored in the memory 13 to be transmitted back to the newly inserted operational device. The memory 13 may be arranged, for example, in a sensor connected to the operational device 10.

If a sensor is connected to the operational device 10 and a memory 13 is present, different modulation values may also be stored or else programmed in the memory 13 for different sensor values, for example brightness values in the case of a light sensor. According to one embodiment, different modulation values may thus be stored in the memory, even in the case of different sensor values (for example brightness values), by means of the method according to the invention (that is to say a manipulation sequence) and these values, as a type of reference table, may predefine the respective modulation value for the power converter 14.

However, provision may also be made for the initial state to be restored by executing a reset sequence. The stipulated operational parameter value (for example the dimming level) can therefore also be retained beyond a normal switching-off operation (normal off). The initial state is then restored only after the reset sequence has been executed.

The invention can be delimited from the switch-dim (TRIDONIC®) or touch-dim technology by virtue of the fact that the information, that is to say the manual operation of a switch, is directly effected via the voltage supply. In the case of touch-dim and switch-dim, the dimming information is preferably supplied to the operating apparatus by a pushbutton or switch via a signal input (the actual voltage supply is independent of this).

The electronics which are needed to implement the invention and discriminate the rapid switching-on and switching-off operation from the normal switching-on and switching-off operation are preferably accommodated in the cap region of the lamp (or of the retrofit LED lamp).

It is also possible to provide an energy buffer, for example a capacitor, which bridges at least a "mains failure", a switching-off operation, within the scope of the rapid switching-on/switching-off operation, with the result that the electronics can evaluate the switching sequence.

At the time at which a dimming setting desired by the user is present, the user can therefore stipulate this setting by executing the second switching sequence.

The sensory reproduction need not necessarily be effected by the luminous means themselves (color temperature change, dimming, etc.) but rather can also be effected by other elements (further optical elements, acoustic elements, etc.).

Different operational parameter changes can therefore be effected by manipulating the voltage supply, these changes being able to be discriminated, for example, using different manipulation criteria (manipulation or switching sequences).

Alternatively, different operational parameter changes may also cyclically alternate, with the result that, for example, a first manipulation sequence (double click) initiates a cyclical first operational parameter change, for example a dimming value change, which is then replaced by a second operational parameter change, for example a color location change during the next double click, etc.

It is also possible to choose another operating mode, for example the dimmed mode, from the switched-on state by means of a manipulation sequence (for example off-on or off-on-off-on in rapid succession, that is to say within a predefined period).

Particularly when using a plurality of lamps on a voltage supply, it is important for all lamps to be operated with the same modulation values, for example at the same dimming level, that is to say to have the same (light) emission value. Different lamps will normally have a randomly distributed and therefore also different time base. The luminous means therefore behave differently in the modulation phase, thus resulting in a non-uniform light image.

According to the invention, any operational parameter change (for example dimming-down/dimming-up) is now carried out using an AC voltage, for example the mains voltage, as the time base. In this case, the zero crossings of the voltage are preferably the time base used to synchronize the operational parameter change.

Figure 3:
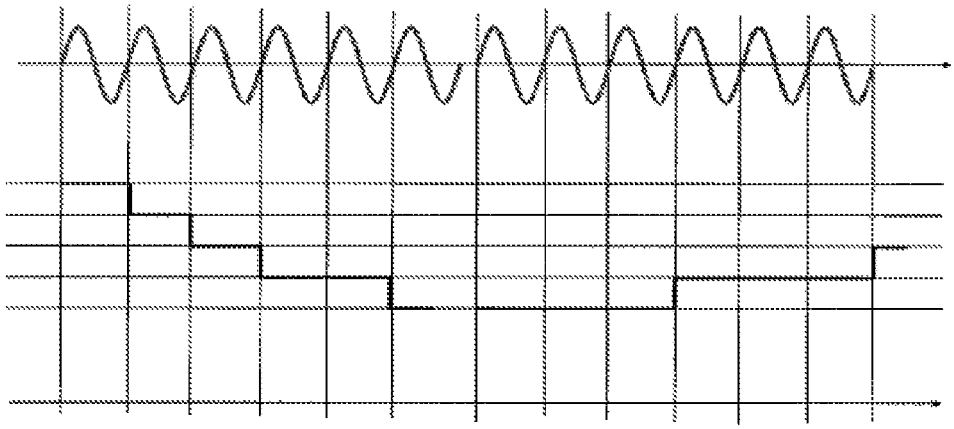
FIG. 3 schematically shows synchronization of an operational parameter change with voltage cycles.

More precisely, the gradient and thus also the period between the operational parameter values or the dimming levels to be set are defined at a predetermined number of voltage cycles and not over an absolute period, for example "10 seconds". This is illustrated in FIG. 3. The top part of FIG. 3 illustrates voltage cycles. The bottom part of FIG. 3 illustrates how the operational parameter change (dimming-down and dimming-up steps) is produced on the basis of the voltage cycles.

As already mentioned, the invention was described, in particular, with regard to LED lamps, in particular retrofit LED lamps. However, it should be understood that the invention can also be used for accordingly configured operational devices for other luminous means.

The invention claimed is:

1. A method for predefining an operational parameter of an operational device for luminous means, the luminous means being controlled via a power converter the method comprising:

optionally manually switching a voltage supply of the operational device on/off, the operational device evaluating whether the switching-on/switching-off operation satisfies at least one first predefined criterion, if so, initiating a discrete or continuous change in the operational parameter to be predefined, the changing operational parameter being directly or indirectly reproduced for the user in an optical and/or acoustic manner, and recording the current value of the changing operational parameter for subsequent operation of the luminous means at the time at which a further operation of switching the voltage supply on/off satisfies at least one second criterion.

2. The method as claimed in claim 1, further comprising:

storing the current value in a memory in response to the detection of the further switching-on/switching-off operation, and operating the luminous means using the value stored for the operational parameter in the memory.

3. The method as claimed in claim 1, effecting the optical and/or acoustic reproduction by an optical and/or acoustic signaling means in addition to or as an alternative to the luminous means.

4. The method as claimed in claim 1, further comprising:

detecting a third switching sequence, which switching sequence again causes the continuous changing of an operational parameter with which the luminous means are operated.

5. The method as claimed in claim 1, further comprising resetting the operational parameter of the operational device to a starting value after a predetermined switched-off time.

6. The method as claimed in claim 1, further comprising resetting the operational parameter of the operational device to a starting value after a further switching sequence is detected.

7. The method as claimed in claim 1, comprising carrying out the switching sequences using a switch or pushbutton.

8. The method as claimed in claim 1, wherein the voltage supply is an AC voltage and the operational parameter is changed in synchronism with the profile of the AC voltage.

9. The method as claimed in claim 8, comprising determining and using the zero crossings of the AC voltage as the time base for synchronizing the change in the operational parameter.

10. The method as claimed in claim 8, wherein the duration of the change between the first value and the second value of the operational parameter is defined at a predetermined number of AC voltage cycles.

11. The method as claimed in claim 1, wherein the operational parameter is at least one of an operating mode selection, a dimming level, a parameter which influences the spectrum of the LED as the luminous means, and a power with which the luminous means are operated.

12. A control circuit designed to operate a luminous means using the method as claimed in claim 1.

13. The control circuit as claimed in claim 12, comprising an integrated circuit.

14. The control circuit as claimed in claim 13, wherein the integrated circuit is at least one of a microcontroller and an application-specific integrated circuit (ASIC).

15. The method as claimed in claim 1 wherein the luminous means comprises at least one LED.

16. The method as claimed in claim 1 wherein the power converter is clocked at high frequency.

17. The method as claimed in claim 1 wherein the changing operational parameter influences the clocking of the power converter.

18. The method as claimed in claim 17 wherein the clocking is the frequency or the pulse control factor of the power converter.

19. The method as claimed in claim 1 wherein the first predefined criterion comprises time constants or repetition rates.

20. A lamp comprising an operational device and luminous means, having:

a connection for connecting the operational device to a voltage supply, a power converter which is clocked at high frequency to operate the luminous means, a manipulation sequence detector for detecting at least one switching sequence, a modulator which changes an operational parameter, with which the luminous means are operated, at least between a first value and a second value, and a memory which stores a value corresponding to the operational parameter set by the modulator at a time at which the manipulation sequence detector detects a second switching sequence.

21. The lamp as claimed in claim 20 comprising a retrofit LED lamp.

22. The lamp as claimed in claim 20 wherein the luminous means comprises at least one LED.

* * * * *